US006210063B1

(12) United States Patent
Isobe et al.

(10) Patent No.: US 6,210,063 B1
(45) Date of Patent: Apr. 3, 2001

(54) KNOCK TYPE APPLICATOR

(75) Inventors: Toshihiro Isobe; Norio Yamada, both of Tokyo (JP)

(73) Assignee: Pentel Kabushiki Kaisha (JP)

( * ) Notice: Subject to any disclaimer, the term of this patent is extended or adjusted under 35 U.S.C. 154(b) by 0 days.

(21) Appl. No.: 09/355,410

(22) PCT Filed: Nov. 25, 1998

(86) PCT No.: PCT/JP98/05293

§ 371 Date: Jul. 27, 1999

§ 102(e) Date: Jul. 27, 1999

(87) PCT Pub. No.: WO99/28046

PCT Pub. Date: Jun. 10, 1999

(30) Foreign Application Priority Data

Nov. 28, 1997 (JP) ..... 9-344425

(51) Int. Cl.[7] ..... A46B 11/04

(52) U.S. Cl. ..... 401/273; 401/270

(58) Field of Search ..... 401/273, 274, 401/272, 271, 270, 278, 279, 268, 101, 103, 109, 115, 198, 206

(56) References Cited

U.S. PATENT DOCUMENTS 4,792,252 * 12/1988 Kremer et al. ..... 401/206
4,913,175 * 4/1990 Yokosuka et al. ..... 132/317

* cited by examiner

*Primary Examiner*—Gregory L. Huson
*Assistant Examiner*—Huyen Le
(74) *Attorney, Agent, or Firm*—Adams & Wilks

(57) ABSTRACT

A knock type applicator includes a cylindrical shell having a coating liquid storage chamber, a writing tip slidably inserted into an opening portion formed in a distal end of the cylindrical shell, and a valve mechanism between the writing tip and the coating liquid storage chamber. The valve mechanism has a valve element connected to the writing tip. Ribs are formed in an inner wall of the opening portion of the cylindrical shell in a lengthwise direction of the cylindrical shell. The diameter of an inscribed circle connecting apexes of the ribs is dimensioned smaller than the maximum diameter of the writing tip. By this, the ribs bite or project into the writing tip which is advanced in combination with the valve element during knocking operation. As a consequence, the writing tip is cracked by the ribs projected therein. At that time, hardened substance, gelled substance and viscous substance created from the coating liquid in the writing tip are peeled off from the fibers of the writing tip, thus recovering an ink flow passage in the writing tip. A connecting force between the writing tip and the valve element is set smaller than a biasing force exerted to the valve element, and a joining distance between the writing tip and the valve element is set longer than a moving distance of the valve element during knocking operation. Thus, the writing tip would not escape from the valve element even if the knocking force is released by mistake when the hardened substance, gelled substance, etc. of the coating liquid is removed from the writing tip.

25 Claims, 3 Drawing Sheets

KNOCK TYPE APPLICATOR

TECHNICAL FIELD

This invention relates to a knock type applicator or a coating device which contains a suitable coating liquid such as, a writing and painting liquid such as India ink, paint and ink, a cosmetic liquid such as eye liner and lip color, a writing correction liquid, and adhesives, and serves to move a prescribed member by knocking it so that a valve mechanism disposed in the applicator is opened to discharge the liquid.

BACKGROUND OF THE INVENTION

Heretofore, there has been known an applicator (a coating device) which comprises a cylindrical shell with a coating liquid storage chamber defined therein, a coating body such as a pen point and a writing tip secured to an opening portion formed in a distal end of the cylindrical shell, and a valve mechanism disposed between the coating body and the coating liquid storage chamber.

In a coating device of the type as described, a knock portion disposed on the cylindrical shell is knocked or pushed to move a movable member disposed in the coating liquid storage chamber and the movable member, in turn, moves a valve element to open the valve mechanism so that the coating liquid is ready to be discharged from the storage chamber to an object to be coated.

However, the conventional device has such problems that when the device is not used for a long period of time or when the cover member is left removed, the coating liquid stored in the coating body and between the coating body and an inner wall of the opening portion of the distal end of the cylindrical shell is prone to create a hardened substance, a gelled substance and a viscous substance due to evaporation of moisture and solvent thereby choking the flow passage for the coating liquid, and therefore, a smooth flow of the coating liquid is interrupted.

Various attempts and proposals have been made in order to solve the above problems.

For example, Japanese Utility Model Publication No. 2-309 of 1989 discloses a writing device with a side knock valve having a writing body with a valve element fixed thereto and capable of containing therein a liquid, and the writing body is slidably inserted in a cavity formed in a distal end of a cylindrical shell, and a pigment ink flow passage formed between an outer surface of the writing body and an inner surface of the distal end of the cylindrical shell, and at least a part of the resilient cylindrical shell is defined as a resilient body, the resilient body being displaced by knocking the cylindrical shell so that the valve element and writing body will be slidingly moved simultaneously.

With respect to this utility model publication, the coating body is slidingly moved simultaneously with the opening operation of the valve element which is made by knocking the cylindrical shell, for the purpose of flowing ink smoothly by recovering the ink flow passage, just in case the flow passage is choked with ink composition which has been hardened by drying, in such a manner as to peel off and/or crush the lumps of ink.

Although the writing device of the above utility model publication can recover a region of the coating liquid flow passage between the coating body and the inner wall of the distal end portion of the cylindrical shell, it is impossible for this device to recover a region of the coating liquid flow passage in the coating body which passage is choked with the hardened substance, gelled substance and viscous substance of the coating liquid.

This is especially true when the coating body is a writing/painting brush because when the coating liquid stored in the writing tip is hardened or gelled or becomes viscous, fibers constituting the writing tip are mutually adhered, thereby making it impossible to feed and coat the coating liquid smoothly.

SUMMARY OF THE INVENTION

In view of the above, it is, therefore, an object of the present invention to provide a knock type applicator or a coating device in which when it occurs that a coating liquid can not be discharged smoothly due to adhesion of fibers of a writing tip caused by a hardened substance, a gelled substance and a viscous substance created by the coating liquid in the writing tip, the hardened substance, etc. are peeled off or crushed by a sliding movement of the writing tip so that the coating liquid can be discharged again in a smooth manner.

In order to achieve the above object, the present invention employs a construction in which ribs are formed in an inner wall of an opening portion formed in a distal end of a cylindrical shell in a lengthwise direction of the cylindrical shell, and the diameter of an inscribed circle connecting apexes of the ribs is dimensioned smaller than the maximum diameter of the writing tip.

The employment of this construction makes it possible to discharge the coating liquid smoothly again by loosening the mutually adhered fibers which constitutes the writing tip, by peeling off and/or crushing the hardened substance, gelled substance and viscous substance created by the coating liquid.

In the knock type applicator according to the present invention, the ribs formed on the inner wall of an opening portion of a distal end of the cylindrical shell bite or project into the writing tip which advances in operative connection with a valve element during a knocking operation. As a consequence, the writing tip is cracked by the ribs projected therein. At that time, the hardened substance, gelled substance and viscous substance which are created from the coating liquid in the writing tip are peeled off successfully from the fibers of the writing tip. Thus, an ink flow passage in the writing tip can be recovered.

Since an end face of the opening portion formed in the distal end of the cylindrical shell serves as a fulcrum for the writing tip to make a flexible bowing movement, the ribs bite or project deep into the writing tip to crack it so that the hardened substance, gelled substance and the viscous substance in the writing tip are peeled off and/or are crushed from the fibers of the writing tip and discharged outside the writing tip together with the coating liquid. Therefore, the writing tip is hardly adhered after the coating liquid is discharged.

In the case where the flow passage in the writing tip can not be completely recovered in spite of a sliding movement of the writing tip and biting of the ribs during a coating operation, it can be contemplated that the adhered writing tip is loosened by rubbing it to the surface of a sheet of paper or loosened by fingers or other similar means, in order to remove the hardened substance, gelled substance and viscous substance. At that time, the above-mentioned means is carried out while slidingly moving the writing tip. By doing so, even that part of the writing tip received in the interior of the cylindrical shell can be loosened during a coating operation, i.e., discharging operation. In this way, the adhered writing tip can be loosened over a comparatively large range of area and the hardened substance, etc. can be removed.

The present invention has such other additive structural features as described hereinafter, in addition to the above-mentioned construction as a basic feature. The other additive structural features are: a force for connecting the writing tip and valve element together is smaller than a biasing force exerted to the valve element, and a joining distance between the writing tip and the valve element is longer than a moving distance of the valve element during a knocking operation of a knock portion.

Employment of these additive structural features makes it possible to prevent escape and breakage of the writing tip liable to occur during a removing operation of the hardened substance, gelled substance and viscous substance in the writing tip after peeling off and/or crushing of the hardened substance, etc. by a knocking operation.

For removing the hardened substance, etc., it is an ordinary practice that the writing tip is projected from the cylindrical shell as far as possible by a knocking operation and then the writing tip is picked up with fingers. If the knocking force exerted to the knock portion is released accidentally or by mistake during a removing operation, the valve element is moved backward and the writing tip is moved relatively forward. At that time, if the connecting force between the writing tip and the valve element is smaller than the biasing force exerted to the valve element, there is such a fear that the writing tip is escaped from the valve element, thus making it unable to carry out a coating operation. In contrast, if the connecting force between the writing tip and the valve element is larger than the biasing force exerted to the valve element, there is a fear that a part of the writing tip, which is comparatively small in strength, is broken because the writing tip resists the biasing force exerted to the valve element, thus again making it unable to carry out a coating operation.

By employing the above-mentioned additive structural features, the above problems can be solved amicably and even if the knocking force is released by mistake, the writing tip does not escape from the valve element.

DETAILED DESCRIPTION OF THE PREFERRED EMBODIMENTS

Figure 1:
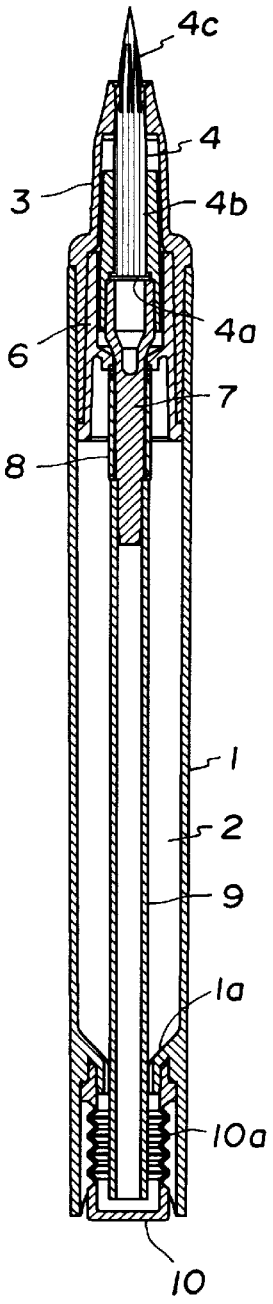
FIG. 1 is a vertical sectional view of a knock type applicator during a non-knocking operation, according to an embodiment (Embodiment 1) of the present invention.
Figure 2:
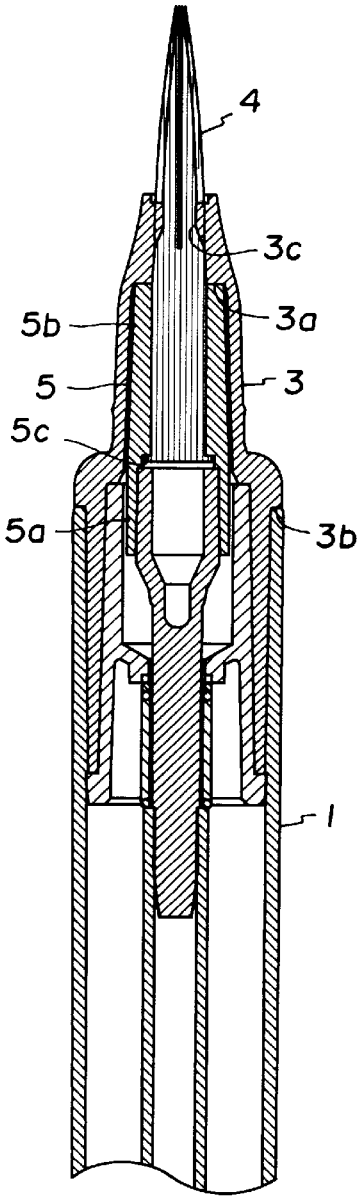
FIG. 2 is a vertical sectional view of an essential portion thereof, during a knocking operation.

FIGS. 1 to 4 show Embodiment 1 of the present invention. In those Figures, reference numeral 1 denotes a rear shell having a coating liquid storage chamber 2 defined therein and reference numeral 3 denotes a front shell whose front portion (upward portion in FIG. 1) is in the form of a reduced-diameter portion and whose rear portion is in the form of an enlarged-diameter portion.

The front shell 3 is fixedly inserted into an opening portion formed in a distal end of the rear shell until a flange portion 3*b* formed on an outer wall of the enlarged-diameter portion of the front shell 3 is brought into abutment with a front end face of the rear shell 1, thereby forming a cylindrical shell. The front shell 3 has a stepped portion 3*a* formed on an inner wall of the reduced-diameter portion. Since this stepped portion 3*a* is provided as an abutment portion with respect to a coating body as later described, it may take any desired configuration inasmuch as it can abut with the coating body. For example, ribs may be formed on the front shell 3 or a hole may be formed in the reduced-diameter portion so that the hole is reduced in diameter forwardly.

A writing tip 4 is slidably disposed in an opening portion formed in a distal end of this cylindrical shell.

The writing tip 4 is composed of a plurality of natural fibers such as those of weasels (or martens), horses and pigs, synthetic resin fibers such as nylon, polyethylene terephthalate and acrylic fibers, or a mixture thereof converged in a lengthwise direction. The writing tip 4 includes, at one part thereof, a straight portion 4*b* whose rear end face is fixed, by heat welding or bonding to form a flange portion 4*a* and, at the other part, a tapered portion 4*c* which is reduced in outer diameter towards a front end face thereof.

A writing tip fixing tube 5 is a tubular sleeve-like member having a through hole which comprises an enlarged-diameter hole portion 5*a* and a reduced-diameter hole portion 5*b*. This sleeve-like member has a larger outside diameter than an inside diameter of the opening portion formed in the distal end of the cylindrical shell and also serves as a connecting portion between the writing tip 4 and a valve element as later described.

The writing tip 4 is fixedly held between the stepped portion 5*c* and a front end face of a valve element which will be described presently, with a front portion thereof projecting from the opening portion in the distal end and with the flange portion 4*a* formed on a rear end portion thereof being in abutment with a stepped portion 5*c* which is formed on a boundary between the enlarged-diameter hole portion 5*a* and the reduced-diameter hole portion 5*b* which hole portions are both formed in the writing tip fixing tube 5.

Figure 3:
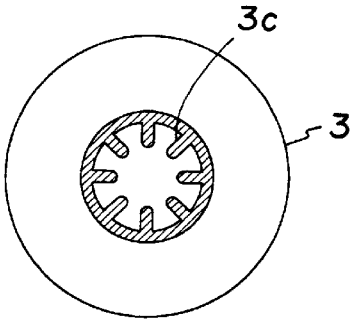
FIG. 3 is a cross sectional view of a front shell according to Embodiment 1.

A plurality of ribs 3*c* are formed on the inner wall of the opening portion of the front shell 3 so that the ribs 3*c* are formed in the distal end in a lengthwise direction (see FIG. 3). The height of the ribs is dimensioned such that the diameter of the inscribed circle connecting the apexes of the ribs 3*c* is smaller than the maximum outside diameter of the writing tip 4.

With respect to the height of the ribs 3*c*, the higher the height is, the greater the striking or biting amount of the ribs 3*c* into the writing tip 4 is. Therefore, it becomes easier to peel off and crush the viscous substance, etc. However, increased height of the ribs 3*c* is associated with such inconveniences that size of the crack in the writing tip 4 is increased with the result of difficulties in discharging the coating liquid and, as a matter of fact, the number of ribs 3*c* is limited. Therefore, the height and number of the ribs can appropriately be set within a range satisfying the above conditions, in accordance with physical properties of the coating liquid and the use of the coating device.

In the writing tip 4, the ribs 3*c* and the tapered portion 4*c* are in confronting relation during non-knocking operation and the ribs 3*c* and the straight portion 4*b* are in confronting relation during knocking operation. Accordingly, the ribs 3*c* and the writing tip 4 are away from each other during non-knocking operation, while the former 3*c* bites or project into the latter 4 during a knocking operation.

There is a provision of a valve mechanism interposed between the writing tip 4 and the coating liquid storage chamber 2.

This valve mechanism is comprised of a cover member 6 formed with a bottom portion 6*a* and a valve element 7 formed with a valve portion 7*a*. The valve element 7 is brought into abutment with the seat portion 6*a* by a spring member, which will be described presently.

The cover member 6 is comprised of a front reduced-diameter sleeve-like portion 6*b* and a rear enlarged-diameter sleeve-like portion 6*c*. A circumferential projection 6*d* directing inward is formed on an inner wall of the reduced-diameter sleeve-like portion 6*c* and the seat portion 6*a* is formed on a front end face of this circumferential projection 6*d*. The cover member 6 is fixedly press-fitted to the inner wall of the rear shell 1 by the enlarged-diameter sleeve-like portion 6*c* and serves to cover the coating liquid storage chamber 2 defined in the rear shell 1.

The valve element 7 is comprised of a front sleeve-like portion 7*b* and a rear sleeve-like portion 7*c*. A valve portion 7*a* is formed between the front sleeve-like portion 7*b* and the rear sleeve-like portion 7*c*. The front sleeve-like portion 7*b* and valve portion 7*a* of the valve element 7 are slidably disposed in the reduced-diameter sleeve-like portion 6*a* of the cover member 6. The valve element 7 is biased backward (namely, towards the knock member 10) by a resilient member 8 such as a coiled spring.

The valve element 7 and the writing tip 4 are connected together with the front sleeve-like portion 7*b* of the valve element 7 slidably inserted into the writing tip fixing tube 5 for a fixed overlapping length. In Embodiment 1, the overlaying distance between the valve element 7 and the fixing tube 5 is equal to the insertion length of the front sleeve-like portion 7*b* into the writing tip fixing tube. It is preferred that the overlapping length is set longer than the moving distance of the valve element 7 during knocking operation for the purpose of prevention of dropping or escape of the writing tip.

Figure 4:
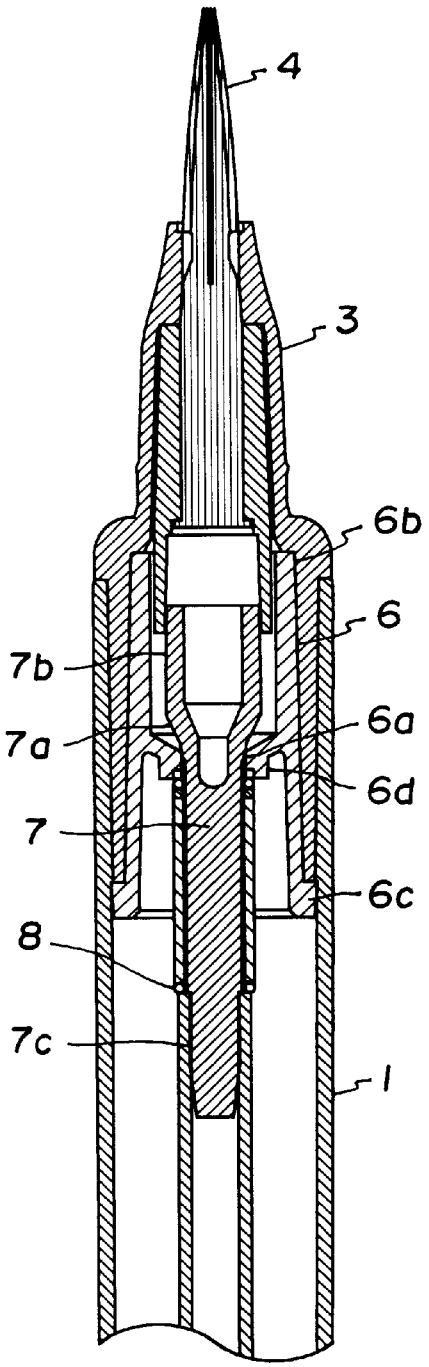
FIG. 4 is a vertical sectional view of the essential portion showing a state in which a pressing force exerted to a knock portion is released when the writing tip is in a held position, during knocking operation.

When a knocking force is released with the writing tip 4 held as shown in FIG. 4, the valve element 7 moves backward but the front sleeve-like portion 7*b* of the valve element 7 is still left inserted in the rear portion of the writing tip fixing tube 5. Therefore, the positional relationship between the writing tip 4 and the valve element 7 is recovered by knocking again.

At that time, the connecting force between the writing tip 4 and the valve element 7, i.e., between the front sleeve-like portion 7*b* of the valve element 7 and the writing tip fixing tube 5 is preferably smaller than the biasing force of the spring member 8 with respect to the valve element 7. By doing so, breakage of the writing tip 4 (especially, flange portion 4*a*) can be prevented. The connecting force can appropriately be set by adjusting the outside diameter of the front sleeve-like portion 7*b* and the inside diameter of the writing tip fixing tube 5.

The rear rod-like portion 7*c* of the valve element 7 is fixedly inserted in a front portion of a connecting sleeve-like member 9 which is disposed in the coating liquid storage chamber 2 defined in the rear shell 1. The sleeve-like member 9 has a rear portion inserted in a sleeve-like knock member 10 having a bottom which is formed on a rear end of the coating liquid storage chamber 2.

The knock member 10 has a bellows-like movable portion 10*a*. It is fixedly inserted to the outer side of the reduced-diameter sleeve-like portion 1*a* formed on the rear end of the rear shell 1.

It should be noted, however, that the knock portion can employ the method known per se and is, by no means, limited to the constructions shown in the embodiment of the invention.

An operation of the applicator according to Embodiment 1 will now be described.

By knocking or pressing the knock button (not shown), the bellows-like movable member 10*a* is contracted to move the sleeve-like member 9 forward. In accordance with movement of the sleeve-like member 9, the valve element 7 moves forward against the spring force of the spring member 8, to thereby open the valve mechanism. Since the writing tip 4 is connected to the valve element 7 at that time, they move forward together. Since the ribs 3*c* of the front shell 3 bite or project into the writing tip 4 due to the forward movement of the writing tip 4, the writing tip is cracked forwardly at the area where the ribs project into.

When the valve mechanism is placed into an opened state, the coating liquid in the coating liquid storage chamber moves into the front shell 3 and discharged outside through gaps among the fibers of the writing tip 4 and a gap between the writing tip and the inner wall of the opening portion formed in the distal end of the front shell 3. The coating liquid discharged outside the front shell 3 is absorbed by and stored in the distal end portion of the writing tip 4 so that it is ready to be coated.

Even in the case where the space for the coating liquid to pass through is not sufficiently large due to presence of the hardened substance, gelled substance and viscous substance of the coating liquid in the writing tip 4, the hardened substance, etc. present at that portion of the writing tip into which the ribs project are peeled off and/or crushed. As a consequence, the coating liquid is absorbed by and stored in that portion so as to be ready for coating.

Figure 5:
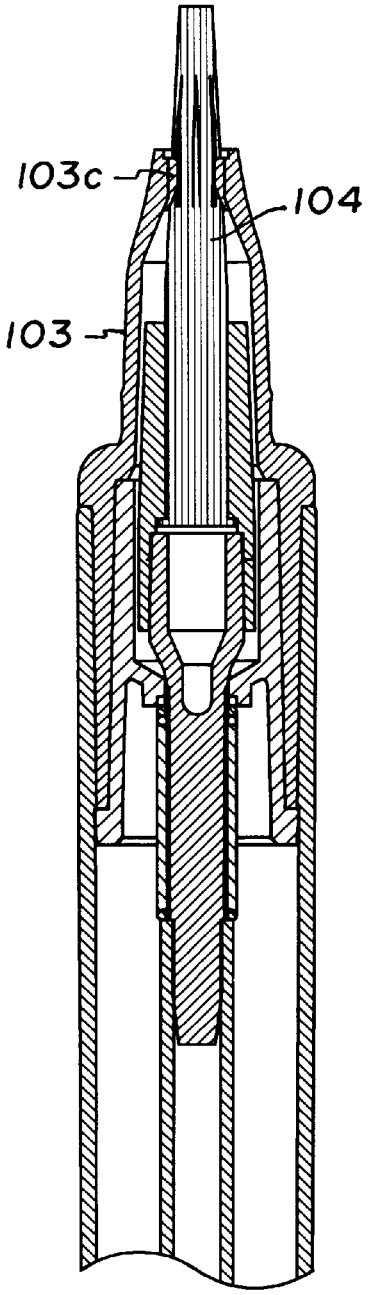
FIG. 5 is a vertical sectional view of a knock type applicator according to another embodiment (Embodiment 2) of the invention, showing the elements during a non-knocking operation.
Figure 6:
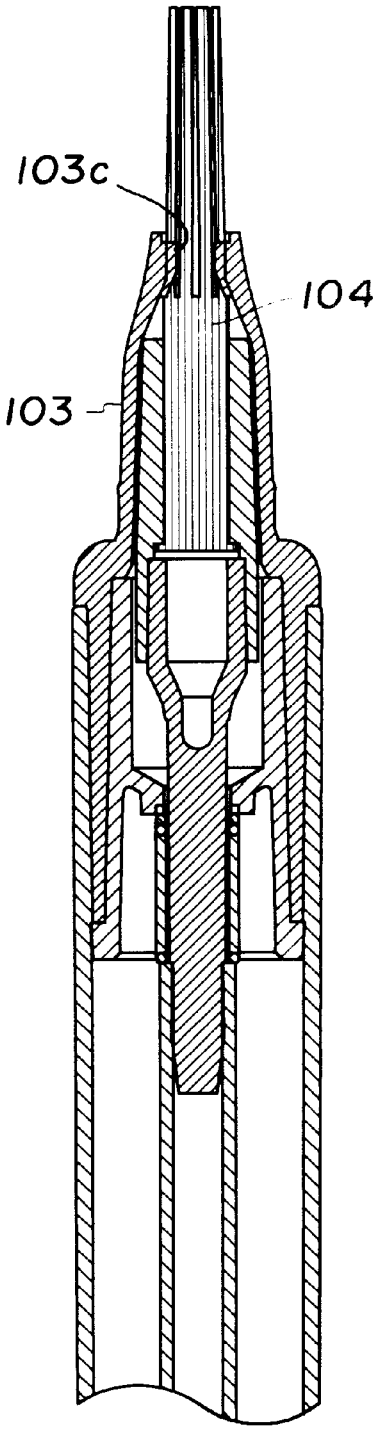
FIG. 6 is a vertical sectional view of the coating device shown in FIG. 5, showing the elements during a knocking operation.

FIGS. 5 and 6 show Embodiment 2 according to the present invention.

Embodiment 2 is same as Embodiment 1 except that the writing tip 4 is replaced by a writing tip 104 with no tapered portion.

Since the ribs 103*c* of a front shell 103 (corresponding to the member represented by reference numeral 3 in FIG. 1) bite or project into the writing tip 104 even during non-knocking operation unlike previous Embodiment 1, the front end portion of the writing tip is cracked. As a consequence, the coating liquid discharged in the front shell during knocking operation is supplied to the front end of the writing tip through the crack even after the knocking operation is canceled. This makes it possible to discharge the coating liquid over a wide range of area in a stable manner.

Since the position where the ribs bite or project comes relatively closer to the rear end of the writing tip due to advancement of the writing tip during a knocking operation, crack in the distal end of the writing tip is enlarged compared with that during a non-knocking operation. Since the hardened substance, gelled substance and viscous substance of the coating liquid present at the portion where crack widely spreads are peeled off or crushed at that time, the same effects as in Embodiment 1 can be obtained.

Here, it should be understood that the ribs may take various configurations and shapes as desired.

Figure 7:
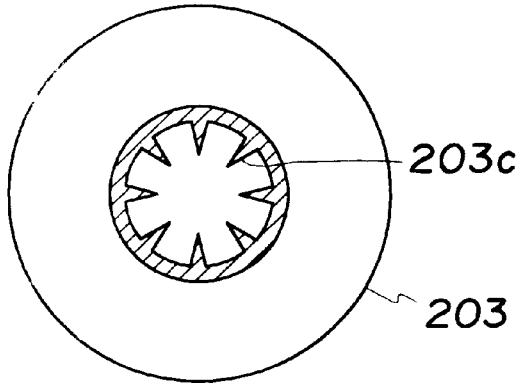
FIG. 7 is a cross sectional view of a front shell according to a further embodiment (Embodiment 3) of the invention.

FIG. 7 shows Embodiment 3. Embodiment 3 is same as Embodiment 1 except that a front shell 203 is provided with ribs 203*c* each having an acute apex.

In Embodiment 3, when compared with Embodiment 1, since the apex of each rib first contacted by the writing tip during knocking operation is acute, resistance encountered by the ribs when they bite into the writing tip is small and therefore, the writing tip is not unnecessarily deformed. Accordingly, those employing the ribs each having an acute apex exhibit such features that the writing tip is readily restored to the state before the knocking operation is made, during non-knocking operation.

Figure 8:
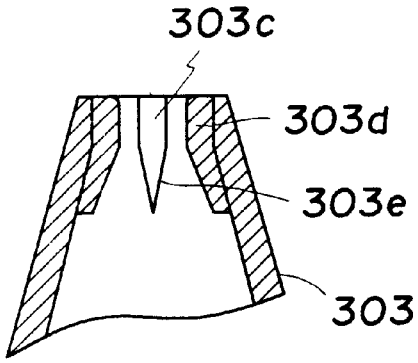
FIG. 8 is a cross sectional view of a front shell according to a further embodiment (Embodiment 4) of the invention.

FIG. 8 shows Embodiment 4 which is the same as Embodiment 1 except that a front shell 303 is provided with ribs 303*c* having a straight portion 303*d* and a tapered portion 303*e*.

In Embodiment 4, when compared with Embodiment 1, since the ribs, when the writing tip contacts the advanced ribs at the time of the knocking operation, bite into the writing tip from the tapered portion, resistance encountered by the ribs when they bite into the writing tip is small and therefore, the writing tip is not unnecessarily deformed. Accordingly, it exhibits such features that the writing tip is readily restored to the state before the knocking operation is made, during non-knocking operation.

The present invention has been described with reference to the preferred embodiments thereof, but it should be noted that the present invention is not limited to those embodiments but many changes can be made without departing from the scope of the appended claims.

What is claimed is:

1. A knock-type applicator comprising: a cylindrical shell having a distal end and a coating liquid storage chamber for storing a coating liquid; a writing tip mounted in the cylindrical shell for slidable movement therein and through an opening portion formed in the distal end of the cylindrical shell, the writing tip having a fiber body comprised of a plurality of fibers forming flow passages for receiving the coating liquid stored in the coating liquid storage chamber; a valve mechanism disposed between the writing tip and the coating liquid storage chamber for controlling a flow of coating liquid from the coating liquid storage chamber to the fibers of the writing tip, the valve mechanism having a valve element connected to the writing tip; and a plurality of ribs extending from an inner wall of the opening portion formed in the distal end of the cylindrical shell and extending in a lengthwise direction of the cylindrical shell for projecting into the writing tip during sliding movement of the writing tip so that the fibers of the writing tip are split by the ribs and solidified, gelled or viscous matters formed by the coating liquid inside the fibers are peeled off the fibers and flow passages inside the writing tip for the coating liquid are recovered, a diameter of an inscribed circle connecting apexes of the ribs being dimensioned smaller than a maximum diameter of the writing tip.

2. A knock-type applicator according to claim 1; further comprising a biasing member for biasing the valve element in a first direction, a connecting member connected to the valve element, and a knock member connected to the connecting member for moving the connecting member during a knocking operation of the knock member to thereby move the valve element in a second direction opposite the first direction; wherein a force for connecting the writing tip and the valve element together is smaller than a biasing force exerted to the valve element by the biasing member; and wherein an overlapping length between the writing tip and the valve element is longer than a moving distance of the valve element during a knocking operation of the knock member.

3. A knock-type applicator according to claim 1; wherein the apex of each of the ribs has an acute angle.

4. A knock-type applicator according to claim 1; wherein each of the ribs comprises a straight portion proximate the distal end of the cylindrical shell and a tapered portion extending from the straight portion and rearwardly from the distal end.

5. A knock-type applicator according to claim 4; further comprising a fixing tube comprised of a sleeve-like member for connecting the writing tip to the valve element, the sleeve-like member having a through hole comprised of a first hole portion, a second hole portion having a smaller diameter than that of the first hole portion, and a stepped portion disposed on a boundary between the first and second hole portions, the sleeve-like member having a larger outside diameter than an inside diameter of the opening portion formed in the distal end of the cylindrical shell; wherein the writing tip is supported between the stepped portion of the sleeve-like member and a front end face of the valve element so that a front portion of the writing tip projects from the opening portion formed in the distal end of the cylindrical shell and a flange portion formed on a rear end portion of the writing tip abuts the stepped portion.

6. A knock-type applicator according to claim 1; wherein the cylindrical shell comprises a rear shell having the coating liquid storage chamber and a front shell having a front portion and a rear portion having a diameter greater than that of the front portion, the front shell being fixedly inserted into an opening portion formed in a distal end of the rear shell so that a flange portion formed on an outer wall of the rear portion of the front shell is in abutment with a front end face of the rear shell, and the front shell having a stepped portion formed on an inner wall of the front portion; and further comprising a fixing tube for connecting the writing tip to the valve element, the fixing tube having an end portion for abutting an abutment surface of the stepped portion.

7. A knock-type applicator according to claim 1; wherein the fiber body of the writing tip converges in a lengthwise direction and has a straight portion having a rear end face forming a flange portion and a tapered portion tapering towards a front end face thereof.

8. A knock-type applicator according to claim 1; further comprising a biasing member for biasing the valve element of the valve mechanism in a direction away from the writing tip; wherein the valve mechanism has a cover member connected to the cylindrical shell and having a seat portion; and wherein the valve element of the valve mechanism has a valve portion which is biased into abutment with the seat portion of the cover member.

9. A knock-type applicator according to claim 8; further comprising a sleeve-like member disposed in the coating liquid storage chamber and having a front part connected to a rear rod-like portion of the valve element and a rear part; and a knock member connected to the rear part of the sleeve-like member for moving the sleeve-like member during a knocking operation of the knock member to move the valve element in a direction opposite to the direction in which the valve element is biased by the biasing member.

10. A knock-type applicator according to claim 8; wherein the cylindrical shell comprises a rear shell and a front shell; and wherein the cover member has a front sleeve-like portion and a rear sleeve-like portion having a diameter greater than that of the front sleeve-like portion and connected to the rear shell by press-fit, the front sleeve-like portion being formed on an inner wall thereof with an inwardly directed circumferential projection, the seat portion being formed on a front end face of the circumferential projection.

11. A knock-type applicator according to claim 10; wherein the valve element has a front sleeve-like portion, a rear rod-like portion, and the valve portion disposed between the front sleeve-like portion and the rear rod-like portion; and wherein the front sleeve-like portion and the valve portion of the valve element are slidably disposed in the front sleeve-like portion of the cover member.

12. A knock-type applicator comprising: a tubular shell having a distal end and a storage chamber for storing a coating liquid; a writing tip mounted in the tubular shell for slidable movement therein and through an opening portion formed in the distal end of the tubular shell; a valve mechanism disposed between the writing tip and the coating liquid storage chamber for controlling a flow of coating liquid from the storage chamber to the writing tip, the valve mechanism having a valve element; a plurality of ribs extending from an inner wall of the opening portion formed in the distal end of the tubular shell and extending in a lengthwise direction of the tubular shell for projecting into the writing tip during sliding movement of the writing tip, a diameter of an inscribed circle connecting apexes of the ribs being smaller than a maximum diameter of the writing tip; and a tubular member for connecting the writing tip to the valve element, the tubular member having a through hole comprised of a first hole portion, a second hole portion having a smaller diameter than that of the first hole portion, and a stepped portion disposed on a boundary between the first and second hole portions, the tubular member having a larger outside diameter than an inside diameter of the opening portion formed in the distal end of the tubular shell; wherein the writing tip is supported between the stepped portion of the tubular member and a front end face of the valve element so that a front portion of the writing tip projects from the opening portion formed in the distal end of the tubular shell and a flange portion formed on a rear end portion of the writing tip abuts the stepped portion.

13. A knock-type applicator comprising: a tubular shell having a distal end and a storage chamber for storing a coating liquid; a writing tip mounted in the tubular shell for slidable movement therein and through an opening portion formed in the distal end of the tubular shell; a valve mechanism disposed between the writing-tip and the coating liquid storage chamber for controlling a flow of coating liquid from the storage chamber to the writing tip, the valve mechanism having a valve element having a valve portion and a cover member having a seat portion; a biasing member for biasing the valve portion of the valve element into abutment with the seat portion of the cover member; and a plurality of ribs extending from an inner wall of the opening portion formed in the distal end of the tubular shell and extending in a lengthwise direction of the tubular shell for projecting into the writing tip during sliding movement of the writing tip, a diameter of an inscribed circle connecting apexes of the ribs being smaller than a maximum diameter of the writing tip.

14. A knock-type applicator according to claim 13; wherein the tubular member comprises a rear shell and a front shell; and wherein the cover member has a front tubular portion and a rear tubular portion having a diameter greater than that of the front tubular portion and connected to the rear shell, the front tubular portion being formed on an inner wall thereof with an inwardly directed circumferential projection, the seat portion being formed on a front end face of the circumferential projection.

15. A knock-type applicator according to claim 14; wherein the valve element has a front tubular portion, a rear rod-like portion, and the valve portion disposed between the front tubular portion and the rear rod-like portion; and wherein the front tubular portion and the valve portion of the valve element are slidably disposed in the front tubular portion of the cover member.

16. A knock-type applicator according to claim 13; further comprising a tubular member disposed in the storage chamber and having a front part connected to a rear rod-like portion of the valve element and a rear part; and a knock member connected to the rear part of the tubular member for moving the tubular member during a knocking operation of the knock member to thereby move the valve element in a direction opposite to the direction in which the valve portion of the valve element is biased by the biasing member.

17. A knock-type applicator comprising: a tubular shell having a distal end and a storage chamber for storing a coating liquid; a writing tip mounted in the tubular shell for slidable movement therein and through an opening portion formed in the distal end of the tubular shell, the writing tip having a fiber body comprised of a plurality of fibers forming flow passages for receiving coating liquid from the storage chamber; a valve mechanism disposed between the writing tip and the storage chamber for controlling a flow of coating liquid from the storage chamber to the fibers of the writing tip; and projecting means for projecting into the writing tip during sliding movement of the writing tip so that the fibers of the writing tip are split by the projecting means and solidified, gelled or viscous matters formed by the coating liquid inside the fibers are peeled off the fibers and flow passages inside the writing tip for the coating liquid are recovered.

18. A knock-type applicator according to claim 17; wherein the projecting means comprises a plurality of ribs extending from an inner wall of the opening portion formed in the distal end of the tubular shell and extending in a lengthwise direction of the tubular shell.

19. A knock-type applicator according to claim 18; wherein a diameter of an inscribed circle connecting apexes of the ribs is smaller than a maximum diameter of the writing tip.

20. A knock-type applicator according to claim 17; wherein the valve mechanism has a valve element connected to the writing tip; and further comprising a biasing member for biasing the valve element in a first direction, a connecting member connected to the valve element, and a knock member connected to the connecting member for moving the connecting member during a knocking operation of the knock member to thereby move the valve element in a second direction opposite the first direction.

21. A knock-type applicator according to claim 20; wherein a force for connecting the writing tip and the valve element together is smaller than a biasing force exerted to the valve element by the biasing member; and wherein an overlapping length between the writing tip and the valve element is longer than a moving distance of the valve element during a knocking operation of the knock member.

22. A knock-type applicator according to claim 17; wherein the tubular shell comprises a rear shell having the storage chamber and a front shell having a front portion and a rear portion having a diameter greater than that of the front portion, the front shell having a stepped portion formed on an inner wall of the front portion and being fixedly inserted into an opening portion formed in a distal end of the rear shell so that a flange portion formed on an outer wall of the rear portion is in abutment with a front end face of the rear shell; and further comprising a tubular member for connecting the writing tip to the valve element, the tubular member having an end portion for abutting an abutment surface of the stepped portion.

23. A knock-type applicator according to claim 17; wherein the valve mechanism has a valve element having a valve portion and a cover member having a seat portion; and further comprising a biasing member for biasing the valve portion of the valve element into abutment with the seat portion of the cover member.

24. A knock-type applicator according to claim 23; wherein the tubular shell comprises a rear shell and a front shell; and wherein the cover member has a front tubular portion and a rear tubular portion having a diameter greater than that of the front tubular portion, the front tubular portion being formed on an inner wall thereof with an inwardly directed circumferential projection, the seat portion being formed on a front end face of the circumferetial projection.

25. A knock-type applicator according to claim 24; wherein the valve element has a front tubular portion, a rear rod-like portion, and the valve portion disposed between the front tubular portion and the rear rod-like portion; and wherein the front tubular portion and the valve portion of the valve element are slidably disposed in the front tubular portion of the cover member.

* * * * *